US006006358A

United States Patent [19]

Keating

[11] Patent Number: 6,006,358

[45] Date of Patent: Dec. 28, 1999

[54] FOOTBALL RECEIVER TRAINING GLOVES

[76] Inventor: Michael L. Keating, 10215 Midway Rd., Dallas, Tex. 75229

[21] Appl. No.: 09/182,259

[22] Filed: Oct. 29, 1998

[51] Int. Cl.[6] ..... A41D 19/00

[52] U.S. Cl. ..... 2/161.1; 2/917; 473/464

[58] Field of Search ..... 2/159, 160, 161.1, 2/161.2, 161.3, 161.4, 161.5, 163, 166; 273/317.5; 473/438, 470, 458, 464, 450, 615

[56] References Cited

U.S. PATENT DOCUMENTS

| | | | |
|---|---|---|---|
| 3,707,730 | 1/1973 | Slider . | |
| 3,931,647 | 1/1976 | Dien . | |
| 4,587,673 | 5/1986 | Boliard | 2/161 |
| 4,665,565 | 5/1987 | Odom . | |
| 5,184,827 | 2/1993 | Suttle et al. . | |
| 5,316,294 | 5/1994 | Turangan | 273/65 |
| 5,414,868 | 5/1995 | Crawford | 2/160 |
| 5,570,882 | 11/1996 | Horkan . | |
| 5,706,521 | 1/1998 | Haney . | |

*Primary Examiner*—Diana Oleksa
*Assistant Examiner*—Katherine Moran
*Attorney, Agent, or Firm*—Akin, Gump, Strauss, Hauer & Feld

[57] ABSTRACT

A pair of training gloves for training a person catching a thrown or kicked American football to position the hands properly for effective catching of the ball includes connector members of hook and loop fastener on the index fingers and thumbs of each glove. The connector members also include straps having elastic sections, and the straps are secured to the tip of the index finger and thumb of one glove. Separate straps also extend laterally from the tip of the little finger and the back of the one glove. The connector members, including the straps on the thumb and index finger on the one glove, are adapted to be secured to the other glove by cooperating pads of hook and loop fastener material sewn to the thumb and index finger of the other glove to provide assumption of the "diamond" position of the hands for catching a ball generally above the waist. The laterally projecting straps on the one glove are releasably securable to pads on the little finger and the backhand portion of the other glove to restrain the gloves, when worn, to cause the hands to assume a shape resembling an inverted "W" for catching a football generally below the waist.

15 Claims, 4 Drawing Sheets

FOOTBALL RECEIVER TRAINING GLOVES

FIELD OF THE INVENTION

The present invention pertains to a pair of gloves adapted to train a football player, particularly a designated pass receiver, to position the hands properly for catching a football generally above the waist and below the waist, respectively.

BACKGROUND

An American football is a difficult object to catch when thrown or otherwise propelled through the air during play. However, the ball is usually, when thrown or punted, rotating about the major axis of its prolate spheroid shape. In this regard, football players whose designated positions, such as pass receivers, require frequent catching of the ball are coached to position their hands in certain ways when receiving the ball generally above the waist and below the waist, the two major catching positions requiring a different positioning of the hands, respectively. For example, football players are typically coached to position their hands with palms facing toward the ball, with the index fingers touching or close to touching and the thumbs touching or close to touching and spread to form a so-called "diamond" shape for catching the ball generally above the waist. Conversely, players are coached to position the hands with palms facing toward the ball, the little fingers just touching each other and the hands spread open to approximate the shape of an inverted letter when catching the ball in a position generally below the waist.

These positions of the hands are not natural and mere verbal admonitions or coaching instructions are not easily followed during training or practice exercises. In this regard, there has been a need to provide a way to emphasize the proper placement of the hands for catching a football both above the waist and below the waist so that during pass receiving and punt receiving training exercises the player's hands, whether a defensive or offensive player, are properly placed so that the player will "remember" during actual play to place the hands in one of the preferred positions for catching the ball. It is to these ends that the present invention has been developed.

SUMMARY OF THE INVENTION

The present invention provides a training aid for training football pass receivers and other players to properly position the hands for catching an American football in positions generally above the player's waist and below the player's waist, respectively.

In accordance with one aspect of the present invention, a pair of training gloves is provided wherein the gloves are releasably attachable to one another to provide for assuming a position of the player's hands with the palms facing away from the player's body and toward a ball to be received and with the index fingers connected to each other and the thumbs connected to each other so that the player's hands can form the so-called "diamond" ball receiving and catching position.

In accordance with another aspect of the present invention, a pair of gloves is provided for use by football players for placing the hands and the palms facing away from the player's body and toward the ball and with the little fingers of the hands touching or close to touching, the palms spread apart and the thumbs open to approximate the shape of an inverted letter "W".

In a preferred embodiment of the invention, the gloves are adapted to be releasably interconnected to each other by connector members which provide for restrained movement of the hands such that when the hands are placed with the palms facing outward to receive a thrown or otherwise propelled football, the hands assume the "diamond" position. Alternatively, the gloves are provided with connector members for interconnecting the gloves such that when the palms of the wearer's hands are facing outward, the gloves restrain movement of the hands so that the hands preferably form the inverted "W" position.

In a preferred embodiment of the training gloves of the present invention cooperating elongated pads of hook and loop fastener material are disposed on the thumbs, index fingers and little fingers of the gloves, respectively. Additionally, straps including portions of hook and loop fastener material are fastened to the index finger and the thumb of one glove for connection to the cooperating pads of hook and loop fastener material on the index finger and thumb of the other glove. One of the gloves of the pair is provided with a strap including hook and loop fastener material connected at one end to the little finger of one glove and a cooperating pad of hook and loop fastener material is secured to the little finger of the other glove.

Furthermore, a strap including a section of hook and loop fastener material is secured at one end approximately mid-palm of the back of one glove and a cooperating pad of hook and loop fastener material is secured approximately mid-palm of the back of the other glove. Still further, the gloves may be provided with small pads of hook and loop fastener material secured to the glove which includes the straps secured thereto for securing the straps in an out of the way position when not in use. Each of the above mentioned straps is preferably formed of or includes a section of an elastic material to allow some elastic stretching and movement of the hands relative to each other to provide for improved catching and retention of the ball when the hands are in both the "diamond" and "W" positions.

Those skilled in the art will further appreciate the above-mentioned features and advantages of the invention together with other superior aspects thereof upon reading the detailed description which follows in conjunction with the drawing.

DETAILED DESCRIPTION OF A PREFERRED EMBODIMENT

Figure 1:
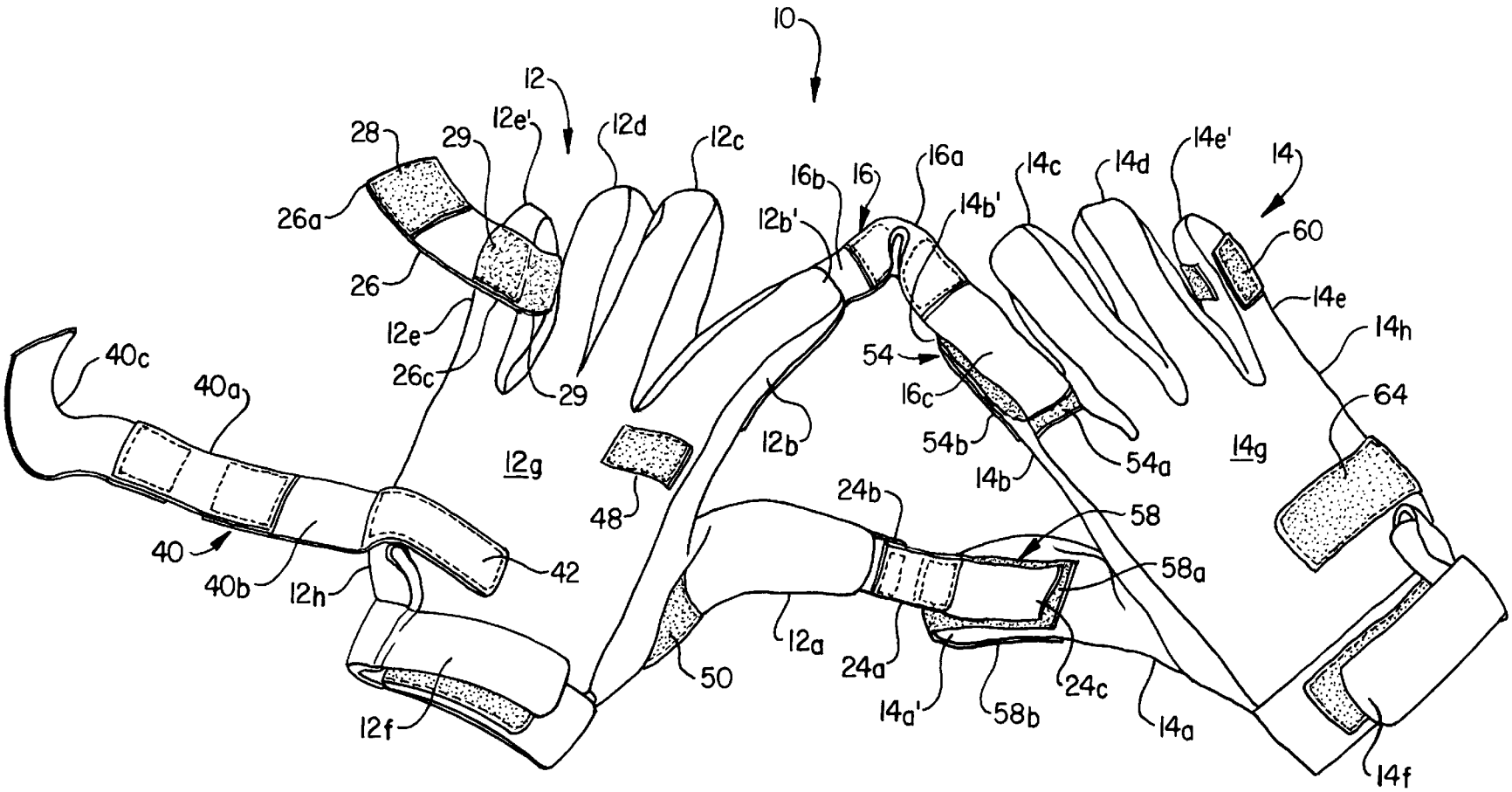
FIG. 1 is a plan view of a pair of football receiver training gloves in accordance with the present invention.

In the description which follows like parts are marked throughout the specification and drawing with the same reference numerals, respectively. The drawing figures are not necessarily to scale and certain features may be shown in somewhat generalized form in the interest of clarity and conciseness.

Referring to FIG. 1, there is illustrated, in plan view, the backhand position of a pair of football receiver training gloves in accordance with the invention and generally designated by the numeral 10. The pair of gloves 10 includes a left hand glove 12 and a right hand glove 14. The left hand glove 12 includes a thumb 12*a*, an index finger 12*b*, a middle finger 12*c*, a third finger 12*d* and a little finger 12*e*. The right hand glove 14 includes a thumb 14*a*, an index finger 14*b*, a middle finger 14*c*, a third finger 14*d* and a little finger 14*e*. The pair of gloves 10 may be formed of a material suitable for athletic gloves, including gloves permitted to be worn by pass receivers and other players in American football regulated games. The gloves 12 and 14 may be formed of a suitable flexible material, such as nylon and/or leather, for example, and in accordance with the teaching of U.S. Pat. Nos. 4,589,429 issued Jul. 8, 1996 and 4,689,832 issued Sep. 1, 1987, both to Lewis W. Mulvaney. The gloves 12 and 14 are typically fabricated to be snug or tight fitting on the wearer's hands and, typically, have releasable strap closures 12*f* and 14*f* on the base ends thereof, respectively, for retaining the gloves on the wearer's hands during use.

Figure 2:
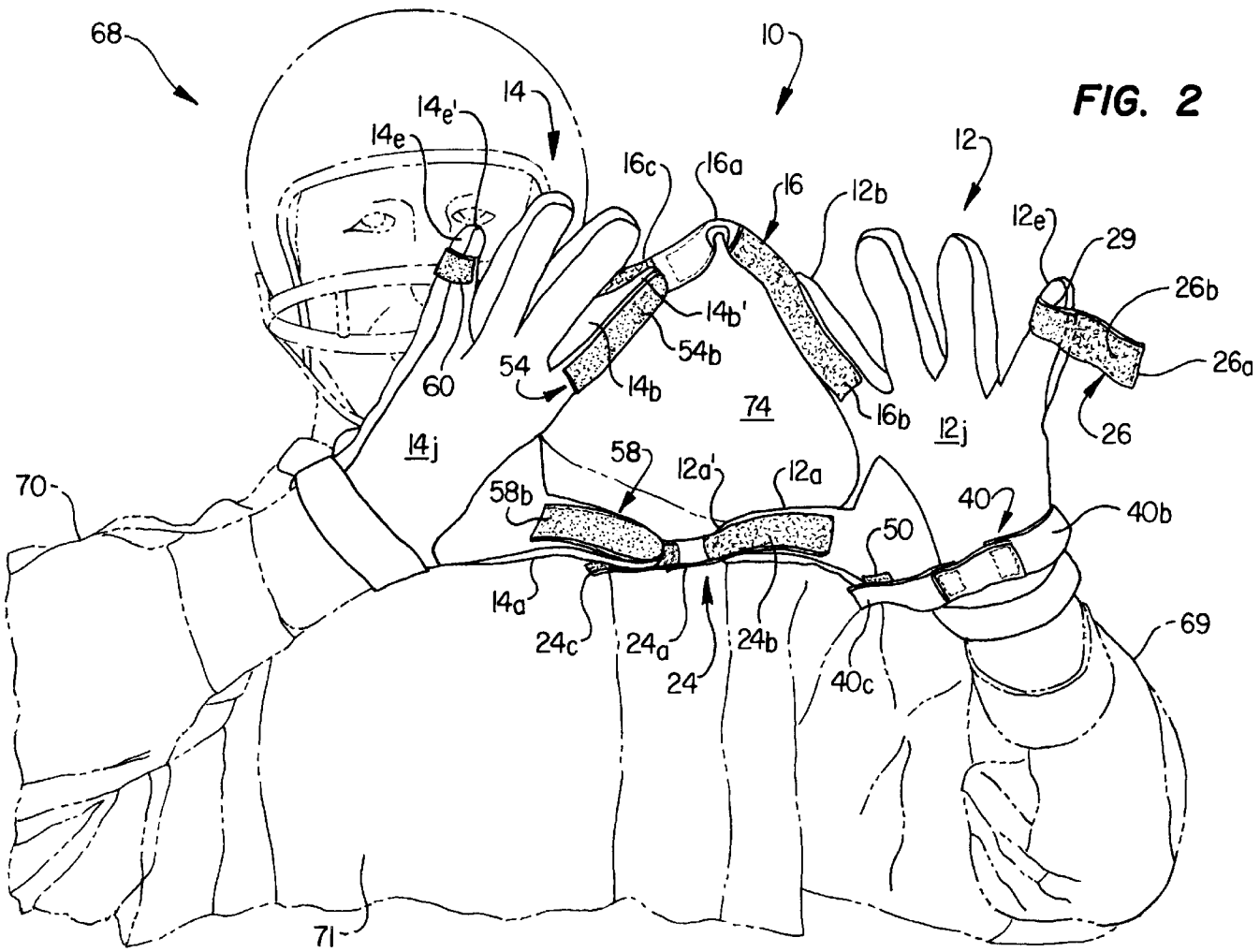
FIG. 2 is a view showing the gloves being worn during a training exercise and connected to each other in the "diamond" position of the hands for catching a football generally above the receiver's waist.

Referring further to FIGS. 1 and 2, the glove 12 is preferably provided with a connector member comprising an elongated strap 16 sewn to the tip of the index finger 12*b* at suitable stitching, not shown. The strap 16 extends, preferably, longitudinally outwardly from the tip 12*b*' of the index finger 12*b* and is preferably formed of a section 16*a* of woven elastic fabric and interposed elongated sections 16*b* and 16*c* of loop fastener material suitably secured together by conventional stitching. Strap section 16*b* has its loop fastener material facing outwardly and section 16*b* is secured directly to glove finger 12*b*. The entire strap 16 may not require to be elastic whereby only a section of the strap may have high elasticity, as shown and described. The other glove connecting straps to be described herein may be made of similar materials and in sections suitably secured together. The hook and loop fastener material may be of a type sold under the trademark VELCRO. The strap sections 16*b* and 16*c* may be the hook or loop part, preferably the loop part of cooperable hook and loop fastener members.

The glove 12 also includes a second connector member including an elongated strap 24, FIGS. 1 and 2, secured to the inner or palm side of the thumb 12*a* of the glove 12 by conventional stitching and extending longitudinally from the distal end 12*a*' of the thumb 12*a*. Strap 24 includes an elastic section 24*a* interposed loop fastener sections 24*b* and 24*c* which face outwardly, as shown in FIG. 2, away from glove 12. Still further, referring to FIGS. 1 and 2, the glove 12 includes a strap 26 sewn to the back 12*g* of the glove at the little finger 12*e* by conventional stitching and projecting substantially laterally at the distal end 12*e*' of the little finger. Distal end 26*a* of the strap 26 includes a pad 28 of hook fastener material secured thereto by conventional stitching. The strap 26 is also preferably formed to include a loop member 26*b* of cooperating hook and loop fastener members facing the palm side of glove 12, as shown in FIG. 2, and facing opposite the pad 28. Still further, a partial ring 29 of outwardly facing loop fastener extends substantially around and is secured to glove finger 12*e* and extends over the end 26*c* of strap 26 attached to the glove finger 12*e*.

Referring further to FIG. 1, the glove 12 also includes in elongated strap 40 secured approximately mid-palm to the back 12*g* of glove 12 by suitable stitching and projects generally from outer edge 12*h* of the glove opposite the direction of the thumb 12*a*. Strap 40 comprises an elastic section 40*a* interposed loop fastener sections 40*b* and 40*c* both of which face the same direction as the loop fastener sections of straps 16, 24, and 26, that is in the same direction as the palm 12*j* of glove 12.

Lastly, with respect to glove 12, relatively small pads 48 and 50 of hook fastener material are secured, respectively, to the base of finger 12*b* of glove 12 and to the base of thumb 12*a* of glove 12 in the positions generally as shown, and are secured to the glove by conventional stitching. The size of the pad 50 may be sufficient to accommodate securing the distal ends 24*c* of the strap 24 and 40*c* of the strap 40 to the pad 50 when the straps are not in use, as will be understood from further description herein. In like manner, the pad 48 is provided for securement of the distal end 16*c* of the strap 16 thereto in an out of the way position when the strap 16 is not in use. The length of strap 26 is normally not sufficient to interfere with use of the pair of gloves 10 when the strap 26 is not in use.

Referring further to FIGS. 1 and 2, the right hand glove 14 is provided with an elongated pad 54 of hook fastener material sewn to finger 14*b*, including a section 54*a* preferably sewn to the back of index finger 14*b* and extending from a point between the base of the finger and a wearer's second knuckle, around the distal end 14*b*' and including a section 54*b* extending to a corresponding point on the palm side of the glove finger, for connecting the strap sections 16*b* and 16*c* of glove 12 to the glove 14. Conventional stitching may be used to secure the pad 54 to the glove finger 14*b*.

In like manner, a similar elongated pad 58 of hook fastener material is secured, preferably by stitching, to the thumb 14*a* extending inwardly from the distal end 14*a*' on both sides of the thumb to form fastener sections 58*a* and 58*b*. Section 58*a* is cooperable with the strap 24 for releasably securing the glove thumbs 12*a* and 14*a* to each other. Connector member sections 24*b* and 58*b* may also be engaged with each other for releasably securing thumbs 12*a* and 14*a* to each other.

Still further, referring to FIG. 1, the little finger 14*e* of glove 14 includes a pad 60 of hook fastener material secured substantially therearound adjacent the distal end 14*e*', also, preferably, by conventional stitching. The pad 60 extends, preferably, laterally across the palm side and the back of the finger 14*e* adjacent distal end 14*e*'. Lastly, an elongated pad 64, FIG. 2, of hook fastener material is secured to the back 14*g* of glove 14 approximately in the mid-palm position across from thumb part 14*a* and extending generally to outer edge 14*h*. The pad 64 of hook fastener material is also preferably secured to the glove 14 by conventional stitching.

When the training gloves 12 and 14 are to be secured to each other to train a football pass receiver to place the hands in the "diamond" position, generally as shown in FIGS. 1 and 2, with the glove palms 12*j* and 14*j* facing away from a person or receiver 68 wearing the gloves, the receiver's arms 69 and 70 raised and held away from the torso 71 and with the hands placed at any position generally above the player's waist, the strap 16 is releasably secured at its distal end part 16*c* to the pad portion 54*a* and the strap 24 is releasably secured at its distal end part 24*c* to the pad portion 58*a*. The distal end 40*c* of strap 40 may be stored in an out of the way position by folding the strap 40 back in a somewhat loop position and securing the strap part 40*c* to one of the pads 48 or 50. Moreover, the pad 28 of strap 26 may be secured to the portion of ring connector part 29 overlying strap end 26*c* to secure the strap 26 in an out of the way position, if desired.

Accordingly, when a training exercise is carried out to throw footballs in receiving positions generally above the waist, the gloves 12 and 14 are donned and the straps 16 and 24 are secured as described above so that the hands, with the palms facing outward, as shown in FIG. 2, will automatically be restrained to, essentially, assume the "diamond" position of the hands. Moreover, the gloves 12 and 14 may be brought closer together such that the connector members formed by the sections 16*b* and 54*b* comprising the hook and loop fastener members may be brought into contact with each other. In like manner, the connector members formed by the strap sections 24*b* and 58*b* may be brought into contact with each other, particularly at the tips of the glove thumbs so that the "diamond" shape of the hands may be slightly smaller, initially. In this way, as the receiver 68 makes contact with the ball when catching same, the impact of the ball will tend to separate the thumbs and fingers of the player's hands but the straps 16 and 24 will only allow the player's hands to separate to a certain extent to assist in catching the ball. Of course, the ball receiver 68 is also attempting, at that instant, to grip the ball and any effort by the receiver to forcibly separate the hands will be sufficient to overcome the connecting force of the hook and loop fastener materials forming the connector members of the pair of gloves 10 so that the hands are free for any activity required. Those skilled in the art will appreciate that the configuration of the connector members of the pair of gloves 10 provides for a very useful training exercise to assist the receiver in placing the hands in the proper position for catching a ball, generally above the waist.

As this exercise is repeated, a person wearing a pair of gloves 10, connected as described and shown, will be trained to place the person's hands in the position shown in FIG. 2, generally, for receiving a ball thrown high or generally above the waist. Thanks also to the provision of the strap sections 16*a* and 24*a* of a suitably elastic material, the wearer of the pair of gloves 10 connected for catching a ball with the hands assuming the "diamond" position is more likely to catch the ball since the shock of the ball striking the hands in the "diamond" position will allow the straps 16 and 24 to stretch and allow the wearer to firmly grasp the ball as the ball projects through the opening 74, FIG. 2, during the catching event.

Figure 3:
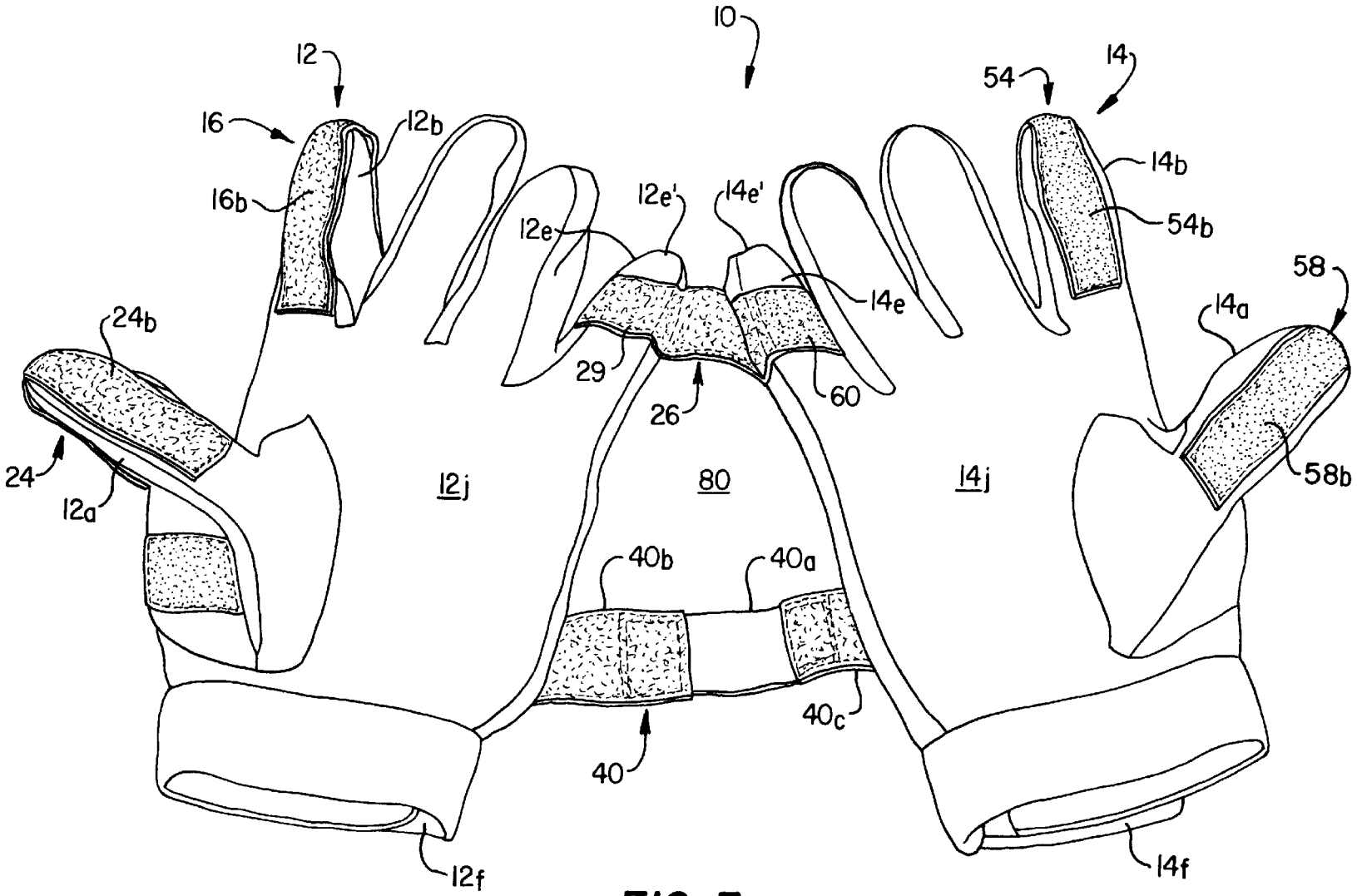
FIG. 3 is a plan view of the palm side of the gloves connected to each other in the so-called "W" ball receiving position.
Figure 4:
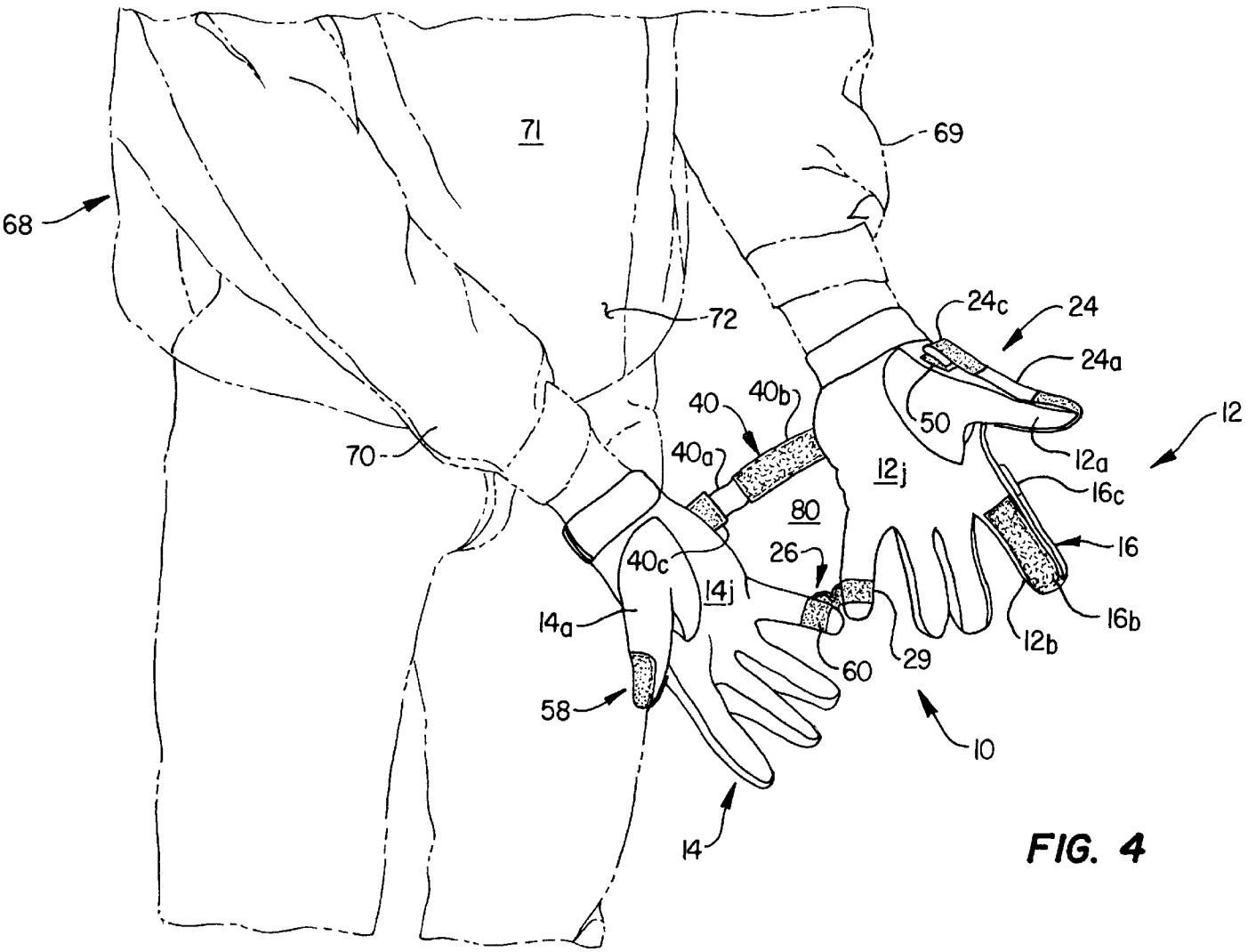
FIG. 4 is a view of a person wearing the gloves connected to each other as shown in FIG. 3 and in a position of the hands for catching a ball generally below the receiver's waist.

Referring, now to FIGS. 3 and 4, the pair of gloves 10 is shown with the palms facing out and the gloves 12 and 14 secured to each other to assume the inverted "W" position for catching a ball generally below the receiver's waist 72, as shown in FIG. 4. In order to prepare the gloves 12 and 14 for training a person to confine the hands to the positions of the gloves shown in FIGS. 3 and 4, the straps 16 and 24 are disconnected from the glove 14 and the strap distal end parts 16*c* and 24*c* are secured in an out of the way position to the pads 48 and 50, respectively, see FIG. 4. The strap 26 is then secured at its distal end connector part 26*b* to the little finger 14*e* by connecting the parts 26*b* and 60 to each other. In like manner, the distal end part 40*c* of strap 40 is secured to the pad 64 of glove 14 so that the receiver's hands are restrained to assume the inverted "W" position.

FIG. 4 illustrates the ball receiver or person 68 with arms 69 and 70 outstretched, hands in gloves 12 and 14 and in the proper position to catch a football generally below the waist 72. Initially, the inverted "W" position may be assumed by bringing the distal ends 12*e*' and 14*e*' of the glove little fingers 12*e* and 14*e* into contact with each other at the connector members, comprising the parts 60 and 29, releasably connected as a consequence of these parts being hook and in loop fastener members, respectively. However, the hands are spread at the wrists to assume the position shown in FIG. 4. On contact with a football, the fingers 12*e* and 14*e* may separate at the connection between the members 29 and 60 but the strap 26 will restrain separation of the fingers further unless forcible action by the receiver 68 to separate the arms 69 and 70 is undertaken. Again, thanks to the provision of the elastic straps 26 and 40, the receiver's hands may move away from each other at least slightly to vary the size of an opening 80, FIGS. 3 and 4, to facilitate easier catching and retention of a ball.

Although the length of the straps 16, 24, 26 and 40 may vary with the size of the gloves 12 and 14, a preferred overall length of the strap 16 is approximately 7.0 to 8.0 inches with approximately 1.0 inch secured between the first knuckle and the distal end 12*b*' of the finger 12*b* to provide about 2.0 inches of free length of strap section 16*b* while the lengths of strap sections 16*a* and 16*c* are about 1.0 and 3.0 inches, respectively. The lengths of pad sections 54*a* and 54*b* on glove 14 are approximately 2.50 inches, each.

The length of strap 24 is approximately 6.50 inches with strap section lengths of 1.0 inches for section 24*a*, 2.50 inches for strap section 24*b* and 3.0 inches for strap section 24*c*. The lengths of the pad sections 58*a* and 58*b* on glove 14 are about 2.0 inches, each. Still further, the strap 26 sewn to the little finger 12*e* is preferably about 2.0 inches long with about 1.0 inch extending out and away from the finger, as indicated in FIG. 1. The length of the strap 40 extending beyond the edge 12*h* of the glove 12 is preferably about 8.50 inches overall with section lengths of 1.0 inches, 3.50 inches and 4.0 inches for sections 40*a*, 40*b* and 40*c*, respectively. All strap and pad widths are preferably about 0.75 inches, respectively. The pad 64 is approximately 3.0 inches long and extends laterally across the back hand portion 14*g* of the glove 14 at approximately mid-palm or across from the thumb 14*a*.

The fabrication and use of the pair of gloves 10 is believed to be readily understood by those skilled in the art from the foregoing description when read in conjunction with the drawings. The connector members or straps 16, 24, 26 and 40 and the cooperating fastener or connector members on the other glove may, of course, be reversed. Accordingly, the straps may be secured to the glove 14 and cooperating fastener pads described herein secured to the glove 12. Still further, the straps 16, 24, 26 and 40 and their cooperating connector or fastener pads 54, 58, 60 and 64, respectively, may be color coded to assist a person wearing the gloves 12 and 14 to correctly connect the straps to the pads.

Those skilled in the art will further recognize that the straps 16, 24, 26 and 40 and the pads or sections of fastener material secured thereto may be, essentially, integrally formed rather than separate sections sewn to the distal ends of the straps, although the provision of the loop fastener material in relatively small sections at the ends of the straps may facilitate easier use of the gloves when securing the straps to the other glove. As mentioned previously, a significant advantage of using hook and loop fastener connecting members between the gloves 12 and 14 of the pair of gloves 10 is that, when substantial forces are exerted to separate the gloves, the connector members will release to allow the hands to be manipulated for other purposes, such as to continue to perform the practice routine or exercise, to break a fall, or at least to assist in regaining balance during the training exercise.

Although a preferred embodiment of the invention has been described in detail hereinabove, those skilled in the art will recognize that various substitutions and modifications may be made to the invention without departing from the scope and spirit of the appended claims.

What is claimed is:

1. A training aid for training persons to place their hands in predetermined positions for catching a football in at least one of a generally above the waist and below the waist point of reception of the ball, comprising:

a pair of flexible gloves adapted to be worn on the left and right hands of the person being trained, the gloves including cooperating connector members secured to the index finger and the thumb of each glove which are operable to connect to a cooperating connector member on the index finger and thumb of the other glove to restrain the gloves, when worn, such that the person's hands are restrained to assume a position resembling a "diamond" shape formed by the index fingers and thumbs of the gloves, respectively.

2. The training aid set forth in claim 1 wherein:

said connector members comprise elongated pads of hook and loop fastener material secured to the index finger and thumb, respectively, of each pair of gloves, which are cooperable to connect the index fingers and thumbs together, to form the "diamond" shape.

3. The training aid set forth in claim 1 wherein:

said connector members comprise elongated straps secured to at least one of the index finger and thumb of one glove which are adapted to be connected to cooperating connector members secured to the index finger and thumb of the other glove of the pair.

4. The training aid set forth in claim 3 wherein:

said straps include at least a section of an elastic material.

5. The training aid set forth in claim 3 wherein:

said connector members on said other glove are secured to opposite sides, respectively, of the index finger and thumb of said other glove.

6. The training aid set forth in claim 5 wherein:

said straps include sections of hook and loop fastener material secured to the distal ends of said straps, respectively.

7. The training aid set forth in claim 6 if wherein:

said one glove includes at least one pad of hook and loop fastener material secured thereto for connection to the distal ends of said straps for storing said straps on said one glove when said straps are not in use.

8. The training aid set forth in claim 1 wherein:

one of said gloves includes an elongated strap extending substantially laterally from a point adjacent a distal end of the little finger of said one glove and cooperable with a connector member disposed on the little finger of the other glove generally adjacent the distal end thereof and said one glove includes a second strap disposed thereon and projecting substantially laterally from said one glove and cooperable with a connector member disposed on said other glove for connecting said gloves together to limit the separation of said gloves in such a way as to provide for assuming the position of a person's hands in a position resembling the shape of an inverted, letter "W" when the hands are placed palms facing outward away from said person wearing said gloves and positioned below the wearer's waist.

9. The training aid set forth in claim 8 wherein:

at least one of said straps projecting laterally from said one glove includes at least a section formed of an elastic material.

10. The training aid set forth in claim 8 wherein:

said straps include sections of hook and loop fastener material comprising the distal ends thereof and the connector members on said other glove comprise cooperating pads of hook and loop fastener material, respectively.

11. A pair of flexible gloves adapted to be worn on the left and right hands of a person being trained to catch a football in at least one of a generally above the waist and below the waist point of reception of the ball wherein said gloves include cooperating connector members secured to the index finger and the thumb of each glove which are operable to connect to a cooperating connector member on the index finger and thumb of the other glove to restrain the gloves, when worn, to assume a "diamond" position formed by the index fingers and thumbs, and said gloves include connector members disposed on the little finger of each glove generally adjacent the distal ends thereof and one glove includes a connector member disposed thereon and projecting substantially laterally from said one glove and cooperable with a connector member disposed on said other glove for connecting said gloves together to limit the separation of said gloves in such a way as to provide for assuming the position of the hands of a person wearing said pair of gloves in a position resembling the shape of an inverted, letter "W" when said hands are placed palms facing outward away from said person wearing said gloves and positioned generally below said person's waist.

12. The pair of gloves set forth in claim 11 wherein:

said connector members comprise elongated straps secured to the index finger and thumb of one glove and adapted to be connected to cooperating connector members secured to the index finger and thumb of the other glove of the pair.

13. The pair of gloves set forth in claim 11 wherein:

said connector members are color coded to provide for connecting said gloves to each other to provide for said positions of said person's hands when wearing said pair of gloves.

14. The pair of gloves set forth in claim 11 wherein:

one of said gloves includes an elongated strap extending substantially laterally from a point adjacent a distal end of the little finger of said one glove which are cooperable with a connector member disposed on the little finger of the other glove generally adjacent the distal end thereof, and said one glove includes a second strap disposed thereon and projecting substantially laterally from said one glove and cooperable with a connector member disposed on said other glove for connecting said gloves together to limit the separation of said gloves to provide for assuming said position of said person's hands resembling an inverted letter "W".

15. The pair of gloves set forth in claim 12 wherein:

said straps includes sections formed of an elastic material.

* * * * *